US007111661B2

(12) United States Patent
Laugenbach

(10) Patent No.: US 7,111,661 B2
(45) Date of Patent: Sep. 26, 2006

(54) QUICK-ACTION ROLLING SHUTTER DOOR

(75) Inventor: Guido Laugenbach, Kaltenburg-Lindau (DE)

(73) Assignee: Rite-Hite Holding Corporation, Milwakee, WI (US)

( * ) Notice: Subject to any disclaimer, the term of this patent is extended or adjusted under 35 U.S.C. 154(b) by 0 days.

(21) Appl. No.: 10/107,651

(22) Filed: Mar. 27, 2002

(65) Prior Publication Data

US 2002/0139491 A1 Oct. 3, 2002

Related U.S. Application Data

(63) Continuation of application No. 09/446,246, filed as application No. PCT/EP98/03773 on Jun. 19, 1998, now Pat. No. 6,659,158.

(30) Foreign Application Priority Data

Jun. 20, 1997 (DE) ..... 197 26 156

(51) Int. Cl.
*A47H 3/00* (2006.01)

(52) U.S. Cl. ..... 160/270; 160/133; 160/201

(58) Field of Classification Search ..... 160/270, 160/133, 201, 265, 23.1, 271, 188; 52/200, 52/90.1, 762, 780
See application file for complete search history.

(56) References Cited

U.S. PATENT DOCUMENTS 3,655,086 A * 4/1972 Trenner ..... 220/560.05
3,697,126 A * 10/1972 Tiffin et al. ..... 296/137 A
3,724,526 A 4/1973 Huprich
3,772,129 A * 11/1973 Dover ..... 161/43
3,867,494 A * 2/1975 Rood et al. ..... 264/45.3
3,940,524 A * 2/1976 Hoppe et al. ..... 428/86

(Continued)

FOREIGN PATENT DOCUMENTS

| | | | |
|---|---|---|---|
| DE | 1 203 444 | 12/1965 | |
| DE | 24 04 301 | 8/1975 | |
| DE | 24 22 679 | 8/1975 | |
| DE | 2608728 | * 9/1976 | ..... 160/270 X |
| DE | 35 31 633 | 3/1987 | |
| DE | 37 06 789 | 9/1988 | |
| DE | 3706789 | 9/1988 | |
| DE | 295 01 048.7 | 4/1995 | |
| DE | 297 02 894 | 5/1997 | |
| EP | 123508 | * 10/1984 | |
| EP | 0 358 920 | 3/1990 | |
| EP | 0 401 419 | 12/1990 | |
| GB | 2 121 855 | 1/1984 | |
| GB | 2121855 | * 1/1984 | ..... 160/270 X |
| WO | 91/12404 | 8/1991 | |

*Primary Examiner*—Bruce A. Lev
(74) *Attorney, Agent, or Firm*—Hanley, Flight & Zimmerman LLC

(57) ABSTRACT

A quick-action rolling shutter door and modules thereof used for closing openings in the walls of warehouses or factory buildings in order to restrict the loss of energy from heated or cooled rooms, and to protect the environment by keeping escaping noise, odors and dust emissions to a minimum. A flexible quick-action rolling shutter door hanging (12) can be wound up onto a roller, is guided on at least one side by a guiding device, and has at least one thick-walled insulating layer (36, 38) consisting of plastic foam material.

29 Claims, 10 Drawing Sheets

U.S. PATENT DOCUMENTS 3,964,354 A * 6/1976 Johannsen ..... 83/39
3,993,827 A * 11/1976 Dukert et al. ..... 428/251
3,997,632 A * 12/1976 Kloss ..... 261/103
4,020,202 A * 4/1977 Kreft ..... 428/33
4,056,910 A * 11/1977 Hiatt et al. ..... 52/600
4,150,186 A 4/1979 Kazama
4,282,697 A * 8/1981 Spielau et al. ..... 52/746.11
4,304,824 A 12/1981 Karpinski
4,657,614 A * 4/1987 Andersson ..... 156/244.11
4,690,850 A * 9/1987 Fezio ..... 428/105
4,723,588 A * 2/1988 Ruppel ..... 160/236
4,929,497 A * 5/1990 Mitchell et al. ..... 428/265
4,943,473 A 7/1990 Sahatjian et al.
4,951,437 A * 8/1990 Rozzi ..... 52/249
4,979,553 A 12/1990 Lowry, III et al.
5,025,847 A 6/1991 Mueller
5,049,443 A * 9/1991 Kuszaj et al. ..... 428/332
5,533,561 A 7/1996 Forehand, IV
5,617,682 A 4/1997 Christopher
5,638,883 A 6/1997 Schulte
5,695,870 A * 12/1997 Kelch et al. ..... 428/318.4
5,725,933 A * 3/1998 Nishiyama ..... 428/192
5,727,614 A 3/1998 Lichy
5,733,633 A * 3/1998 Lin ..... 428/192
5,738,161 A 4/1998 Martin
5,806,185 A * 9/1998 King ..... 29/897.32
5,921,973 A * 7/1999 Newkirk et al. ..... 604/365
5,957,187 A 9/1999 Gruben
6,089,305 A 7/2000 Gruben et al.
6,098,695 A 8/2000 Schwingle
6,192,966 B1 * 2/2001 Yang ..... 160/370.23
2001/0031350 A1 * 10/2001 Day et al. ..... 428/317.9
2004/0053036 A1 * 3/2004 Gordun Burillo ..... 428/314.4

* cited by examiner

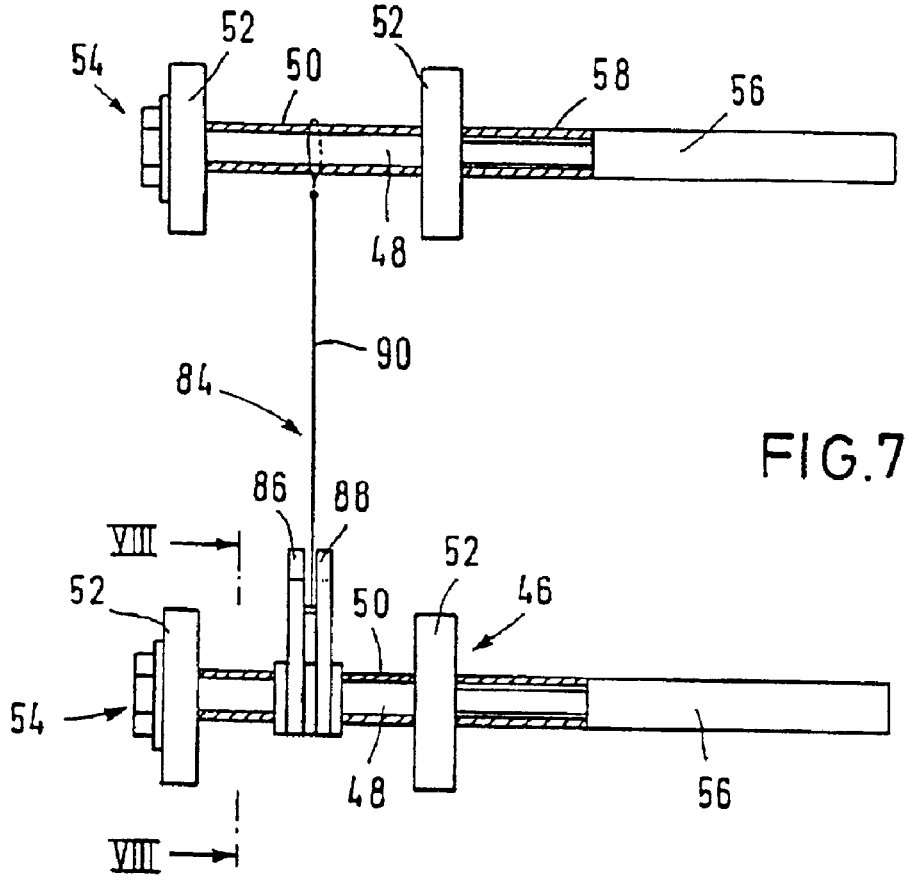
FIG.7
FIG.8
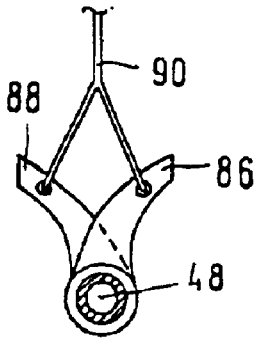
FIG.8a
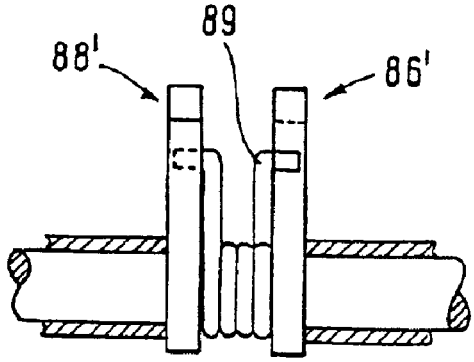

QUICK-ACTION ROLLING SHUTTER DOOR

RELATED APPLICATIONS

This application is a Continuation of U.S. application Ser. No. 09/446,246 filed on Dec. 15, 1999 now U.S. Pat. No. 6,659,158, which was the National Stage of International Application No. PCT/EP98/03773, filed on Jun. 19, 1998.

FIELD OF THE INVENTION

The invention relates to a quick-action rolling shutter door and to modules thereof.

BACKGROUND OF THE INVENTION

Quick-action rolling shutter doors are used for closing openings in the walls of warehouses or factory buildings. Here, it is very important that the quick-action rolling shutter door can be opened and closed fast, only leaving the opening in the wall open for the actual passage of a person or a vehicle there-through. This will, on the one hand, restrict any loss of energy from heated or cooled rooms, and, on the other hand, protect the environment by keeping escaping noise, odors and dust emissions to a minimum.

From practical applications, two types of quick-action rolling shutter door are known. A first type of quick-action rolling shutter door, usually referred to as sectional door, uses rigid door elements which are guided on their sides and, when opened, assume a position parallel to a building wall or ceiling. Said door elements generally include a frame with plural filling inserts of a sandwich construction, similar to the kind used in window or door systems. The K-value of said doors which is between 1.0 to 1.4 can in itself be regarded as good from an energy saving point of view. What is disadvantageous about these doors, however, are their low opening and closing speeds and the high technical effort, amongst other things due to the problems involved in foam-filling the filling inserts with construction material. This construction is not only very problematic when it comes to recycling, but does not afford sufficient protection from burglary, either, since the filling inserts do not offer any resistance.

Another type of quick-action rolling shutter door which is known from practice as the so called hanging or curtain door, uses a thin-walled plastic tarpaulin which is guided on the sides and can be wound up onto a roller. The high opening and closing speeds of this type of quick-action rolling shutter door are obtained at the expense of insufficient thermal insulation, with K-values ranging from 4.0 to 5.75, as well as insufficient safety from burglary.

Both types of quick-action rolling shutter door have disadvantages in relation to heat insulation. The disadvantage of sectional doors in this respect is the formation of cold bridges in the region of the joints interconnecting the individual door elements. The insufficient heat insulation of hanging doors is due to the insufficient insulation properties of the material of the hanging.

Another disadvantage of the prior art quick-action rolling shutter doors is the labor-intensive repair of collision damage. With both types of quick-action rolling shutter door, due to the prior art guiding devices used in them, maintenance work is only possible in the raised, opened state. What makes this shortcoming especially serious is the fact that collisions of vehicles and quick-action rolling shutter door hangings or door elements occur very frequently with quick-action rolling shutter doors. Another disadvantage of the prior art types of quick-action rolling shutter door resides in their insufficient safety from burglary, as already mentioned.

SUMMARY OF THE INVENTION

It is the object of the invention to provide an improved quick-action rolling shutter door with corresponding modules for improving prior art quick-action rolling shutter doors.

This object is solved according to the invention by the features of the claims.

In accordance with claim 1, the flexible hanging of the quick-action rolling shutter door, which is wound up onto a roller and guided on at least one side by a guiding device, should have at least one thick-walled insulating layer consisting of foamed plastic material. The fact that foamed plastic material is used, which has pores and chambers with small air cushions preventing any heat exchange through the quick-action rolling shutter door hanging, results in good heat and cold insulation. To achieve such insulation does not require a major constructional effort since the quick-action rolling shutter door hanging is flexible and can thus be readily wound up onto a roller. This allows high-speed opening and closing actions. Consequently, there will be no hinges, either, which would require special insulation measures.

The hanging of the quick-action rolling shutter door which constitutes a module for a quick-action rolling shutter door and for which protection is also sought separately, independently of claim 1, preferably exhibits some reinforcement onto which the thick-walled insulation layer has been laminated. Said reinforcement, which may comprise a fabric or web of steel wires, steel strands, glass or carbon fibres, or cotton, serves as a barrier preventing any cutting through said quick-action rolling shutter door hanging, thus preventing burglary. A particular good cost-effectiveness ratio is obtained when a steel fabric is used for reinforcement.

For facilitating the winding up of the quick-action rolling shutter door hanging, one of its external sides preferably has expansion slots. In the case of a quick-action rolling shutter door hanging with first and second insulation layers, such layers are preferably glued or welded together along contact lines extending transversely to the direction of travel of said quick-action rolling shutter door. Particularly suitable for gluing together insulating layers of polyethylene foam is cyancacrylate.

Another quick-action rolling shutter door module for which independent protection is sought, is the anti-push-up device as claimed in claim 15. This anti-push-up device, which is provided especially for quick-action rolling shutter doors, is characterized by at least one detent latch which will latch in the guiding device whenever the distance between adjacent track rollers or sliding elements decreases during opening of the quick-action rolling shutter door. The distance between adjacent track rollers or sliding elements will always decrease when the bottom edge of a quick-action rolling shutter door hanging, or of door elements which are slidable relative to each other, is to be lifted. The fact that said at least one detent latch latches in said guiding device will prevent any further lifting of the quick-action rolling shutter door hanging or the door elements in such a case, thus preventing any burglary attempts in this manner. A bracing spring which will force two detent latches apart whenever the quick-action rolling shutter door hanging or the door elements is/are lifted, facilitates the latching process.

Yet another quick-action rolling shutter door module which is very advantageous when used together with a quick-action rolling shutter door hanging of the present invention, is a guiding device for quick-action rolling shutter doors, comprising a guide rail which is essentially U-shaped in cross-section and has a guide space for accommodating track rollers or sliding elements, wherein said guide rail is composed of plural parts. The two legs of the guide rail, which extend essentially in parallel in operation, can be shifted relative to each other, making the guide space freely accessible in its opened state. The fact that the guide space is freely accessible in its opened state allows the maintenance of a quick-action rolling shutter door equipped with such a guiding device in its closed state, which in particular makes an exchange or the cleaning of track rollers or sliding elements of a quick-action rolling shutter door possible. As the quick-action rolling shutter door can be kept closed during maintenance, any energy losses and emissions will be minimal. Moreover, this will facilitate maintenance work since the quick-action rolling shutter hanging and its guiding device are easily accessible.

Another way of minimizing the maintenance and repair work involved in operating a quick-action rolling shutter door is to provide a crash protection device. Such crash protection device for quick-action rolling shutter doors, for which independent protection is also sought, will ensure that the full operativeness of the quick-action rolling shutter door is restored in as short a time as possible after a vehicle has crashed into the hanging or the door elements of the quick-action rolling shutter door. While with quick-action rolling shutter doors of the prior art, parts of the guiding device will become destroyed in a collision, the crash protection device of the invention overcomes this problem in that, in case of a collision with a vehicle, it allows for the releasing of a coupling, thus avoiding the destruction of an element of the guiding device. Preferably, said coupling is designed such that coupling elements which were decoupled or disengaged during the raising of the hanging or door elements of the quick-action rolling shutter door will automatically be coupled or engaged again at funnel-like guide means.

BRIEF DESCRIPTION OF THE DRAWINGS

Other advantageous embodiments and further developments of the invention will become apparent from the subclaims as well as the description which follows in which reference is made to the drawings, of which:

FIG. 7 is one view of an anti-push-up device according to the invention for a quick-action rolling shutter door of FIGS. 1 and 2;

FIG. 8 is a simplified view of a pair of detent latches of the anti-push-up device of FIG. 6;

FIG. 8*a* is a pair of detent latches for a second embodiment of an anti-push-up device, including a torsion spring for forcing said detent latches apart;

DETAILED DESCRIPTION OF THE INVENTION

Figure 1:
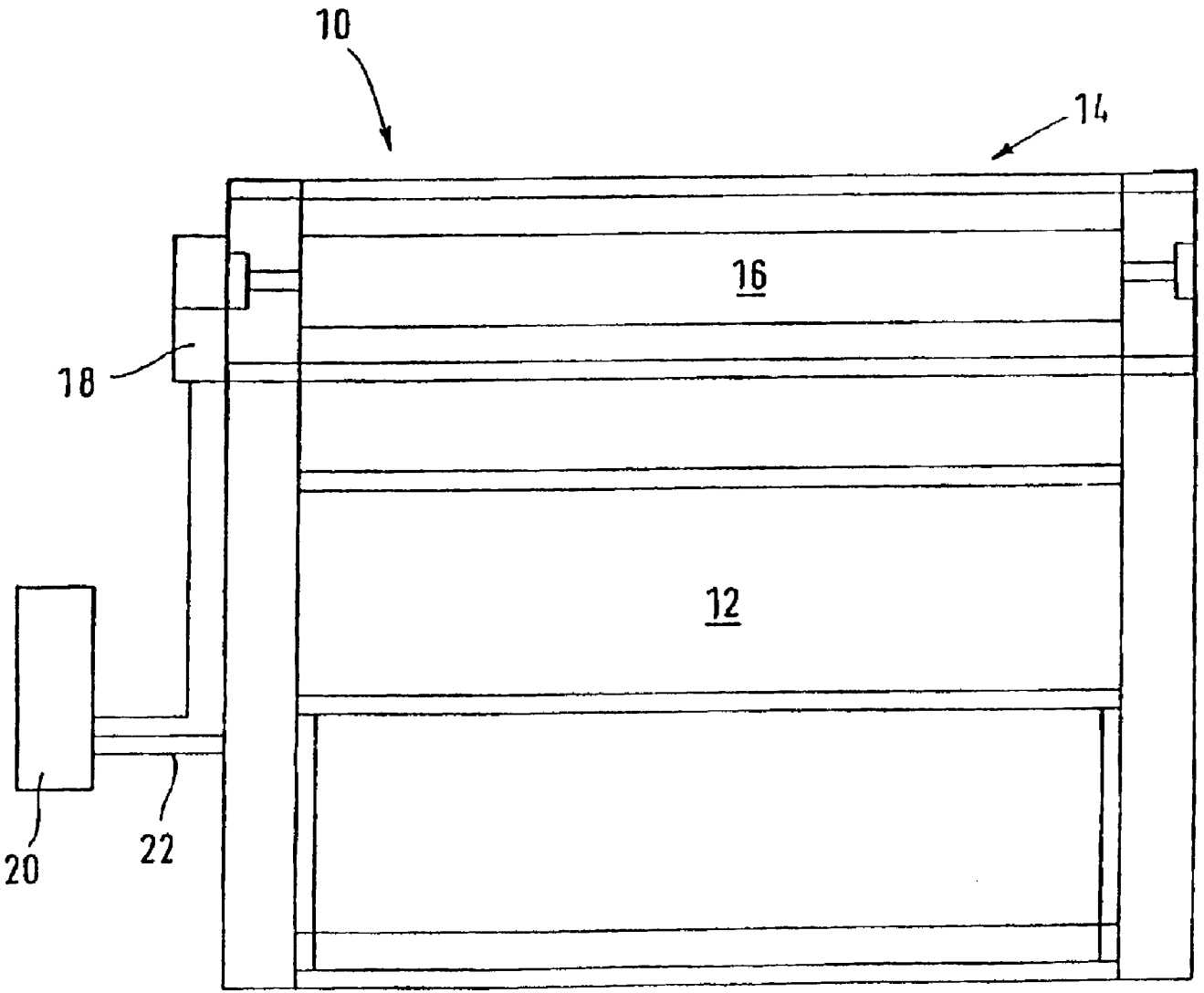
FIG. 1 is a view of a first embodiment of a quick-action rolling shutter door according to the invention, with the roller cover removed.

The first embodiment of a quick-action rolling shutter door 10 according to the invention, shown in FIGS. 1 to 6, consists of plural quick-action rolling shutter door modules. A first quick-action rolling shutter door module is the quick-action rolling shutter door hanging 12 which is guided on the side and at the top by a guiding device 14. Said guiding device 14 includes a roller 16 which can be driven to rotate in either direction by a motor 18. Said motor 18 is controlled by controlling means 20 which will also process signals from contact rails and light barriers supplied via signal lines 22.

Figure 2:
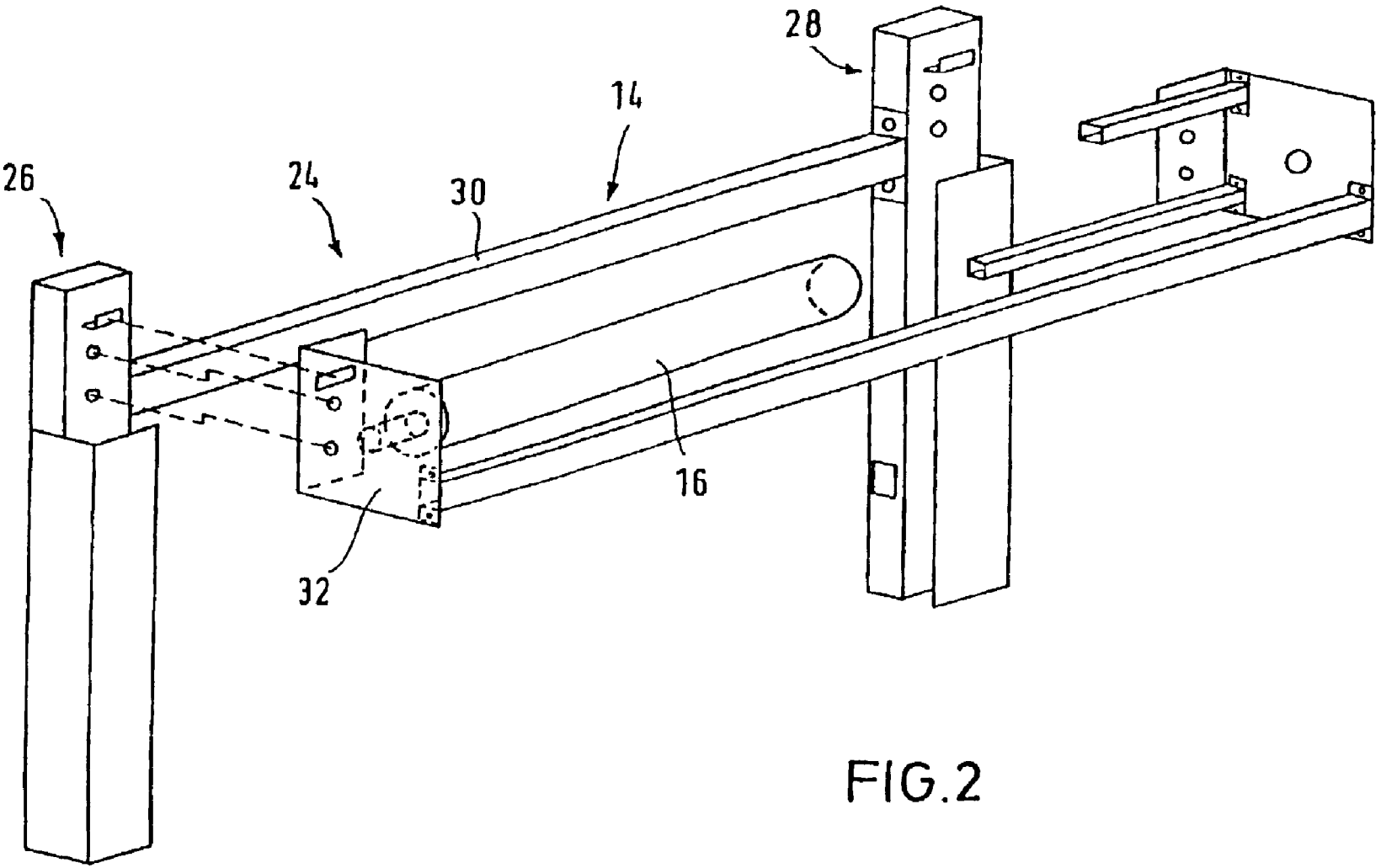
FIG. 2 is a simplified perspective view of the top part of the quick-action rolling shutter door of FIG. 1.

FIG. 2 shows the top part 24 of the guiding device 14. It can clearly be seen in this Figure that the guiding device 14 essentially comprises two lateral guide rails 26, 28 as well as a head beam 30 maintaining the distance between said two guide rails. Extending in parallel to said head beam 30 is a roller 16 supported in roller support means 32.

Figure 3:
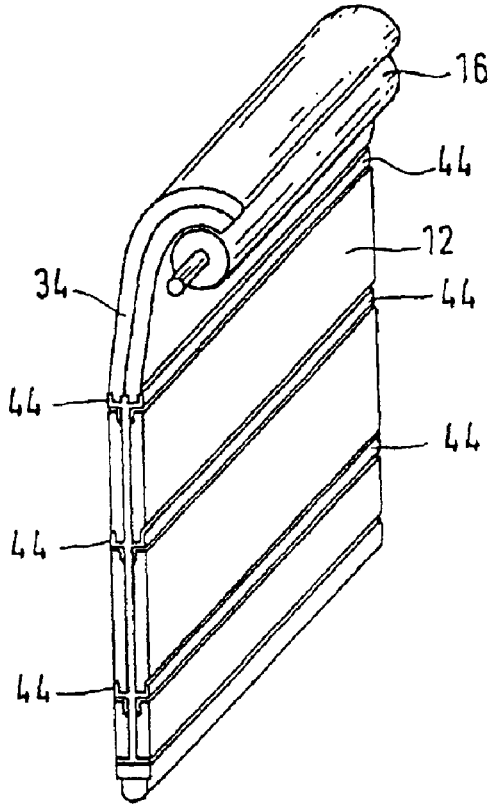
FIG. 3 is a cut-off perspective view of a hanging for a quick-action rolling shutter door of FIGS. 1 and 2.
Figure 4:
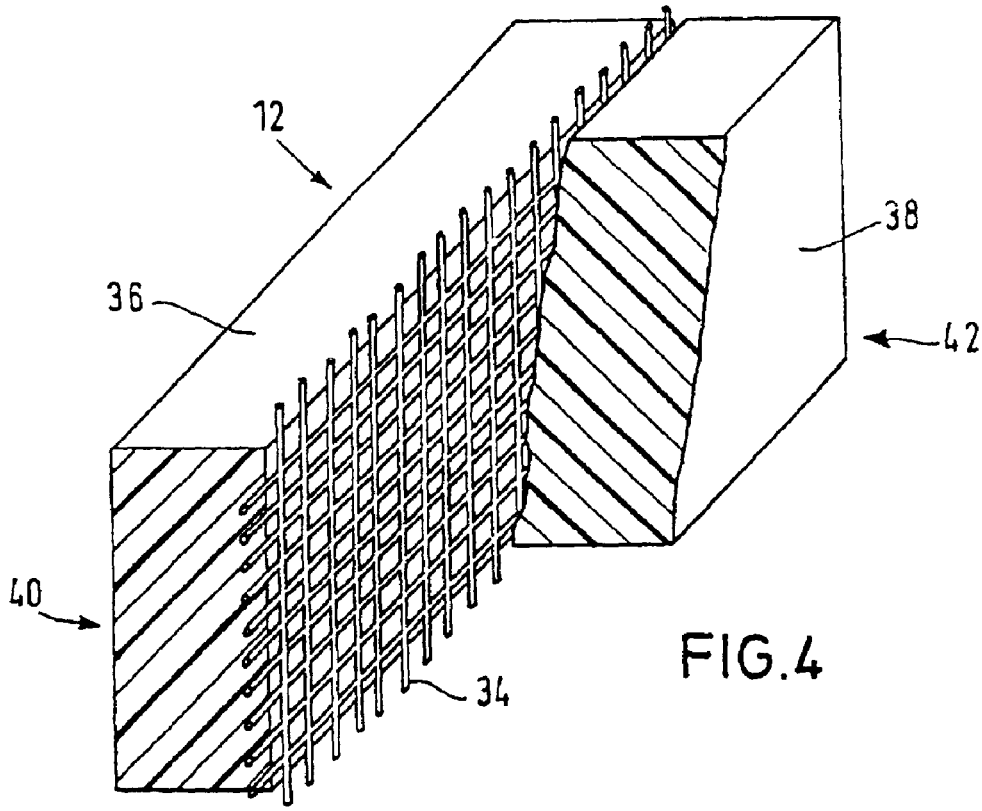
FIG. 4 is an enlarged perspective view of a first section of the quick-action rolling shutter door hanging of FIG. 3.
Figure 5:
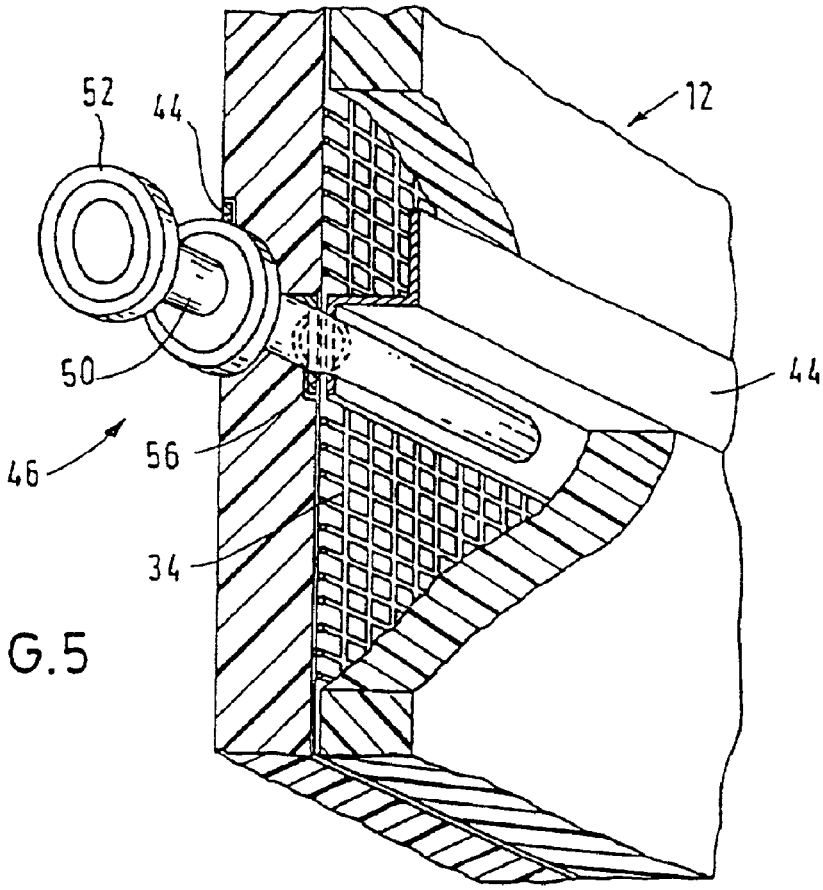
FIG. 5 is an enlarged perspective view of a second section of the quick-action rolling shutter door hanging of FIG. 3.

Crucial for the quick-action rolling shutter door 10 is the quick-action rolling shutter door hanging 12, a first embodiment of which is shown in detail in FIGS. 3 to 5 and further embodiments of which are shown in FIGS. 13 to 17. Like parts are marked with like reference numerals, but increased by 1,000 or 2,000. The quick-action rolling shutter door hanging 12 of the first embodiment illustrated in FIGS. 3 to 5 has a continuous reinforcement 34 of a steel wire fabric, one side of which is laminated with a first insulating layer 36 of a thickness of 25 mm and the other side of which is laminated with a second insulating bayer 38, likewise 25 mm thick. For use as a burglary-proof door on the outside, a steel fabric is laminated into the foamed material. The steel fabric may be of a thickness of between 0.3 mm to 1 mm. The first and second insulating layers comprise a closed-pore polyurethane foam of a density of 30 kg/m$^3$. The first insulating layer is intended to be the external layer and has a smooth fair-faced side 40 which is of the same color as the actual building. The likewise smooth fair-faced side 42 of the insulating layer 38 intended to face inside, by contrast, which may also be customized, is in a glaring color.

The thick first insulating layer, however, may also be structured on the outside, which creates the visual impression of a sectional door.

Figure 13:
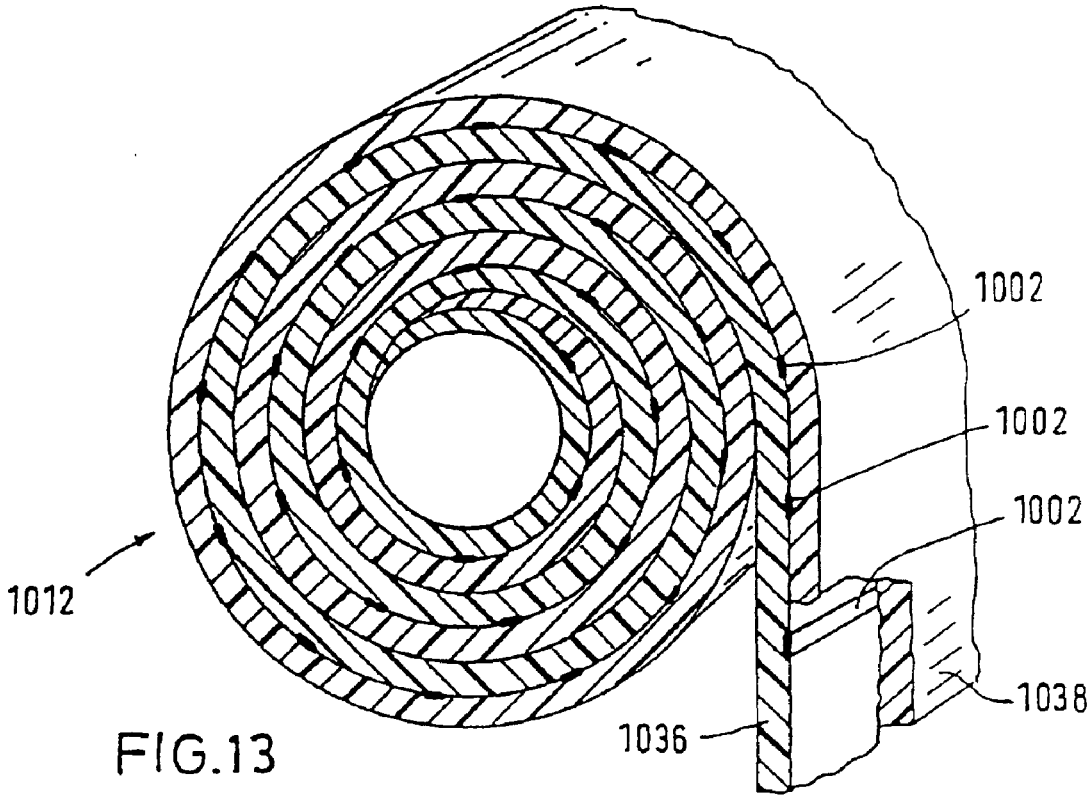
FIG. 13 is a view of a second embodiment of the quick-action rolling shutter door hanging of the invention.

The quick-action rolling shutter door hanging 1012 partially shown in sectional view in FIG. 13, whose reinforcement is not shown therein to keep the drawing simple, has two insulating layers 1036, 1038, which—as opposed to the quick-action rolling shutter door hanging 12 of the first embodiment—are not glued onto each other over their entire surfaces, but merely along contact or glue lines 1002. Said insulating layers 1036, 1038 are made of a cross-linked foamed polyethylene material marked by HT-Troplast AG under the trade name TROCELLEN$^R$ under the specification 3015 SWB F4 UV. This cross-linked foamed polyethylene material has a raw density of 33±3 kg/m$^3$, a longitudinal tensile strength of 0.42 N/mm$^2$, a transverse tensile strength of 0.29 N/mm$^2$, a ductile yield, in the transverse and longitudinal directions, of approximately 200 percent, a temperature application range in the bending test of up to minus 40° C., a dimensional stability up to plus 95° C., a thermal conductivity at 30° C. of 0.038 w/m K, and a water vapour diffusion current density of <3 g/m$^2$ d with a thickness of 10 mm.

Further materials suitable for insulating layers are available from ALVEC under the trade name ALVEOLIT$^R$. The properties of these materials may be noted from the table below:

| Properties | ISO Standard | Unit | TA | TA FR |
|---|---|---|---|---|
| Raw Density | 845 | kg/m$^3$ | 25 | 25 |
| Tensile Strength | 1926 | | | |
| longitudinal | | kPa | 280 | 235 |
| transverse | | kPa | 180 | 155 |
| Ductile Yield | 1926 | | | |
| longitudinal | | % | 125 | 115 |
| transverse | | % | 105 | 95 |
| Upsetting hardness | 844 | | | |
| Upsetting 10% | | kPa | 12 | 13 |
| Upsetting 25% | | kPa | 32 | 32 |
| Upsetting 50% | | kPa | 92 | 92 |
| Pressure Deformation Remainder, 22 h strain, 23° C. Upsetting 25% | 1856-C | | | |
| 0.5 h after strain relieve | | % | 22 | 21 |
| 24 h after strain relieve | | % | 13 | 13 |
| Thermal Conductivity | 2581 | | | |
| at 10° C. | | W/mK | 0.034 | 0.034 |
| at 40° C. | | W/mK | 0.038 | 0.039 |
| Operating Temperature Range | in-house | ° C. | −80/+100 | −80/+100 |
| Water Absorption (7 days) | in-house | % v/v | <1 | <1 |
| Water Vapour Permeability (Thickness) | 1663 | g/m$^2$ × 24 h | 3.8 (2 mm) | |
| μ value (23° C., 0–85% r.F) | 1663 | | 5500 | |
| Shore Hardness 0/00 | in-house | | 17/33 | 15/34 |

| Properties | ISO | Unit Standard | TA FRS | TA FRB | TA FMl |
|---|---|---|---|---|---|
| Raw Density | 845 | kg/m$^3$ | 25 | 25 | 25 |
| Tensile Strength | 1926 | | | | |
| longitudinal | | kPa | 225 | 235 | 225 |
| transverse | | kPa | 140 | 150 | 145 |
| Ductile Yield | 1926 | | | | |
| longitudinal | | % | 100 | 110 | 100 |
| transverse | | % | 80 | 100 | 90 |
| Upsetting Hardness | 844 | | | | |
| Upsetting 10% | | kPa | 12 | 12 | 12 |
| Upsetting 25% | | kPa | 31 | 32 | 32 |
| Upsetting 50% | | kPa | 80 | 95 | 93 |
| Pressure Deformation Remainder, 22 h strain, 23° C., Upsetting 25% | 1856-C | | | | |
| 0.5 h after strain relieve | | % | 22 | 21 | 21 |
| 24 h after strain relieve | | % | 13 | 13 | 14 |
| Thermal Conductivity | 2581 | | | | |
| at 10° C. | | W/mK | 0.034 | 0.033 | 0.033 |
| at 40° C. | | W/mK | 0.039 | 0/037 | 0.037 |

-continued

| | | | | | |
|---|---|---|---|---|---|
| Operating Temperature Range | in-house | ° C. | −80/+100 | −80/100 | −80/+100 |
| Water Absorption (17 days) | in-house | % v/v | <1 | <1 | <1 |
| Water Vapour Permeability (Thickness) | 1663 | $g/m^2 \times 24$ h | | | 1.8 (5.5 mm) |
| μ value (23° C., 0–85% r.F) | 1663 | | | | 4100 |
| Shore Hardness 0/00 | in-house | | 16/29 | 18/29 | 17/27 |

Figure 15:
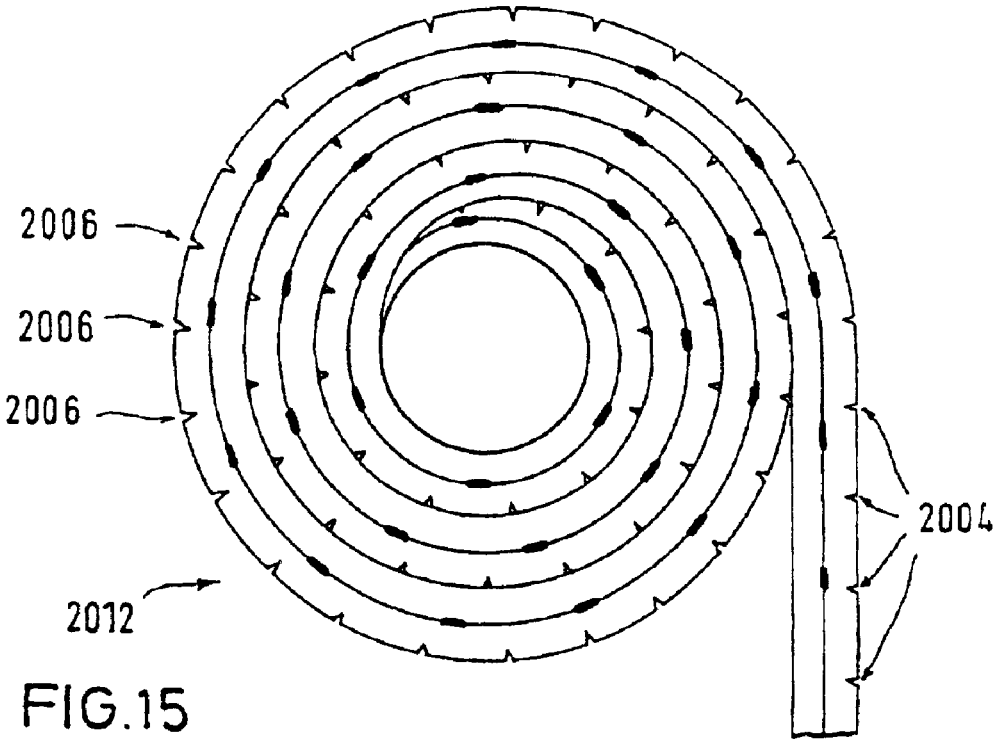
FIG. 15 is a sectional view of a variant of the quick-action rolling shutter door hanging of FIG. 13 including expansion slots.

FIG. 15 shows a variant of the quick-action rolling shutter door hanging 1012 of FIG. 13. This variant of a quick-action rolling shutter door hanging 2012 has expansion slots 2004 on its external side which expand to form notches 2006 during the winding up of the quick-action rolling shutter door hanging 2012, thus contributing to a strain reduction within the material of the quick-action rolling shutter door hanging 2012 and facilitating the winding up onto rollers.

Figure 14:
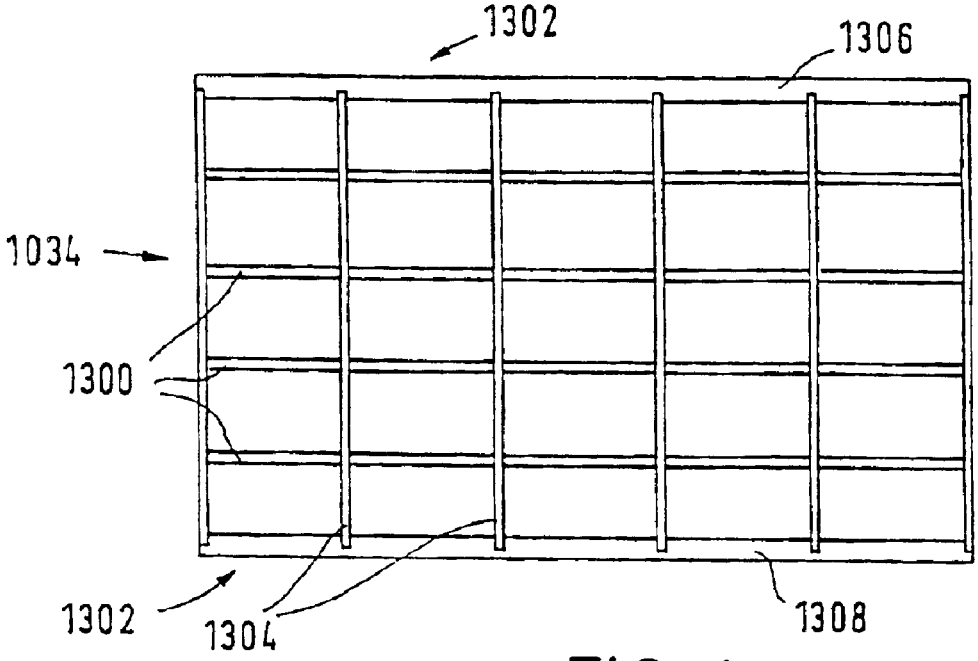
FIG. 14 is a view of the reinforcement of the quick-action rolling shutter door hanging of FIG. 13.
Figure 17:
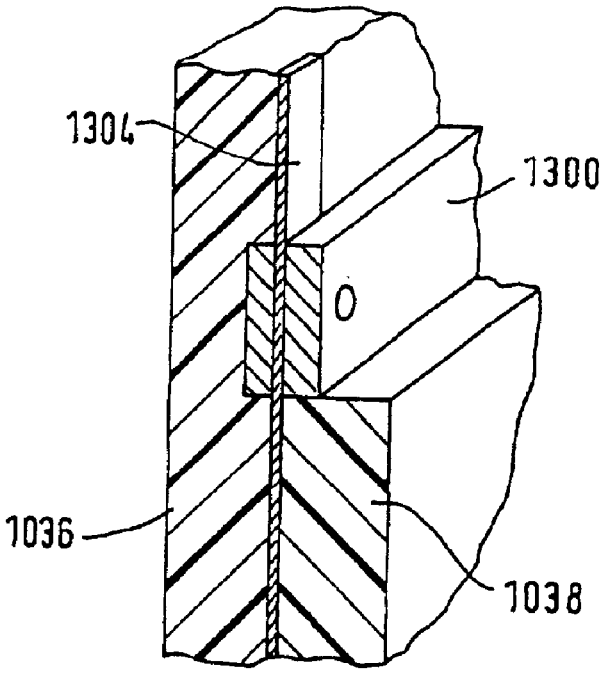
FIG. 17 is a cut-open view of a portion of the quick-action rolling shutter door hanging of the invention including a transverse girder according to yet another embodiment and a longitudinal strap of a reinforcement.

FIG. 14 shows a reinforcement 1034 for the quick-action rolling shutter door hanging which comprises first and second transverse girders 1300, 1302 as well as longitudinal strips 1304. The first transverse girders 1300 are simple aluminum profiles of rectangular cross-section which extend transversely to the direction of travel of the quick-action rolling shutter door hanging and are connected to longitudinal strips at regular intervals by means of through bolts. The longitudinal strips 1304 are flexible metal strips which may easily be wound up, but present a strong resistance towards being cut by knives or other cutting tools. FIG. 17 shows a first transverse girder 1300 and longitudinal strip 1304 together with first and second insulating layers 1036, 1038, respectively.

Figure 16:
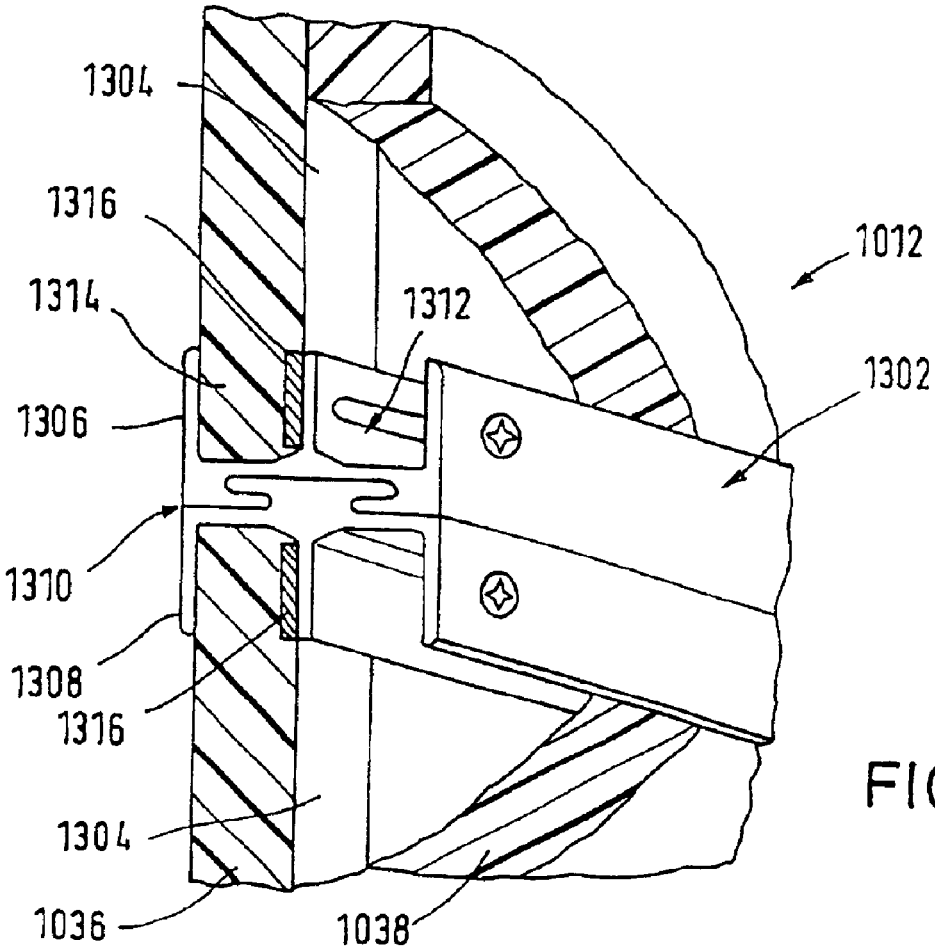
FIG. 16 is a cut-open view of a portion of the quick-action rolling shutter door hanging of the invention including a transverse girder that may be partitioned longitudinally in operation according to yet another embodiment and a longitudinal strip of a reinforcement.

FIG. 16 shows a portion of a quick-action rolling shutter door hanging 1012 with a second transverse girder 1302 which consists of two parts. Said second transverse girder comprises a first transverse girder part 1306 and a second transverse girder part 1308, which two parts are slid into each other such that they can be slidingly separated along a parting line 1310. Said first and second transverse girder parts 1306, 1308 each have two insertion channels 1312, 1314 accommodating the insulation layers 1036, 1038. For interconnection or, if necessary, for connection to first transverse girders 1300, longitudinal strips 1304 are again provided. Said longitudinal strips 1304 are bent U-shaped around holding means 1316 so as to ensure a safe connection of said longitudinal strips 1304 to said transverse girder parts 1306, 1308 via a screwed connection of said longitudinal holding means 1316. For use of the quick-action rolling shutter door hanging 1012 in an environment where heat or cold insulation is important, the second transverse girders 1302 should be designed such that they will not form cold bridges. To this end, the profiles from which the transverse girder parts 1306, 1308 are made may be provided with insulating ribs. As an alternative, second transverse girders 1302 need not be provided altogether since, if first transverse girders 1300 are used exclusively, as shown in FIG. 17, there will not be any cold bridges.

As an alternative to the insulating layer material described, other materials may also be used in the insulating layers, comprising a flexible open- or closed-cell foamed material of a chemically or physically cross-linked type. A closed skin is advantageous. Materials of foamed polyolef ins of a temperature stability up to at least −35° C., preferably −40° C., and a K-value of <2.5 are particularly suited.

Foamed materials which are especially well suited are:

PE—Polyethylene:

Reusable—UV proof—available in any color, behaviour in fire: DIN 4102 B1, B2 class—temperature application range −40° C. up to 105° C.

K-value of between 1 and 1.4—raw density of between 30 and 250 $kg/m^2$.

Foam thickness of between 10 mm and 40 mm for the door insert.

PU—Polyurethane:

Recyclable, UV proof, extremely sound absorbing, temperature stability 40° C. up to, for a short time, 170° C.

K-value 1 to 1.4, raw density between 30 and 250 $kg/m^2$.

Behaviour in fire: DIN 4102 B1, B2 class.

Foam thickness of between 10 mm and 40 mm for the door insert.

EPDM—Synthetic Rubber:

Recyclable and suitable for disposal in household rubbish, UV proof, fire behaviour DIN 4102 B1, B2 class.

Temperature stability from −57° C. to 150° C.

Foam thickness of between 10 mm and 40 mm for the door insert.

PVC—Polyvinylchloride.

For absorbing the wind forces acting on the quick-action rolling shutter door hanging (FIG. 3), antibuckling profiles 44 are provided. These profiles 44 extend on either side of the reinforcement 34 transversely to the direction of travel of the door, bridging the distance between the guide rails 26, 28 of the guiding device 14, and may also serve as the transverse girders of a reinforcement. Said antibuckling profiles 44 extend essentially Z-shaped and have one leg engaging said reinforcement. Their respective other leg engages the external side of the respective insulating layer 36, 38, thus subdividing said insulating layer 36, 38 into individual portions. Since said insulating layers 36, 38 are flexible, as is notable from FIG. 3, and said antibuckling profiles 44 are of low height, the quick-action rolling shutter door hanging 12 of FIGS. 3 to 5 may be wound up onto roller 16.

In order not only to prevent any strong bending or deflection of the quick-action rolling shutter door hanging 12, but to ensure a reliable support of the quick-action rolling shutter door hanging 12 at the same time, track roller means 46 are provided at the ends of said antibuckling profiles 44 which are opposite each other, with said reinforcement 34 in-between. Said track roller means 46—also illustrated in FIG. 6—includes an axle body 48 on which two roller bodies 52, spaced from each other by means of a sleeve 50, are rotatably mounted. One of said roller bodies 52 contacts support screw means 54 provided at one end thereof. The second roller body is supported by a grab body 58, screwed onto said axle body 48 and including a slot 56, so as to loosely contact said sleeve so. In this state, said grab body 58 also encompasses (FIG. 5) a leg each of two opposing antibuckling profiles 44 to which it is at the same time glued, soldered or welded, depending on the material of said antibuckling profiles 44.

Figure 6:
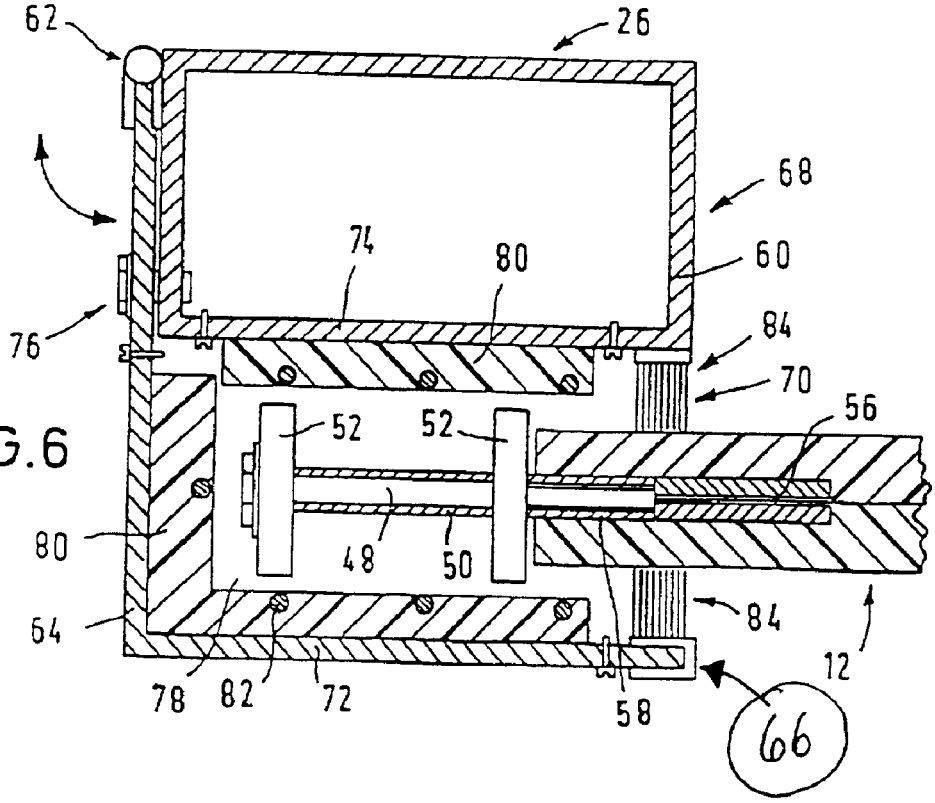
FIG. 6 is a guiding device according to the invention for a quick-action rolling shutter door of FIGS. 1 and 2.

FIG. 6 illustrates how said roller bodies 52, which are supported on their respective axle body 48 and may also be referred to as tandem rollers, are guided in their respective guide rail 26.

The guide rail 26 shown in FIG. 6 includes a support body 60 made of a rectangular square profile. Mounted on said support body 60 by means of a hinge 62 is a swivelling part 64 made of an equal angle profile. The edge length of said swiveling part 64 is somewhat longer than that of the support body, enabling said swivelling part 64 to encompass said support body 60, with a reference edge 66 of said swivelling part and a reference surface 68 of said support body 60 being essentially on one plane at the same time so as to define an oblong aperture 70 therebetween for the quick-action rolling shutter door hanging 12.

In the state illustrated in FIG. 6, the free leg 72 of the swivelling part 64 extends essentially in parallel to a longitudinal wall 74 of the support body 60 so that these two elements, i.e., the longitudinal wall 74 of said support body 60 and the free leg 72 of said swivelling part 64, function almost like parallel legs of a U profile. In order to maintain said support body 60 and said swivelling part 64 in this relative position and thus to prevent this constellation from coming apart in operation, a screwed connection 76 is provided which extends through said swivelling part 64 and engages a threaded bore in said support body 60.

The guide rail shown in FIG. 6 is intended for assembly within a refrigerating chamber. In order to prevent the roller bodies 52 from freezing up and thus blocking, the guide chamber 78 defined by the longitudinal wall 74 and the free leg 72 is lined with heat insulation elements 80 which have at least one heating coil 82 on their internal side for heating said guide chamber 78. Brush bodies 84 provided on either longitudinal side of said aperture 70 will prevent any excessive heat loss from said guide chamber 78.

In order to prevent the rolling shutter door hanging from being pushed up, said quick-action rolling shutter door 10 may be equipped with an anti-push-up device 84. Such an anti-push-up device 84, which is shown in FIGS. 7 and 8, includes two detent latches 86, 88 which are rotatably mounted on the axle body 48 of lower track roller means 46. In this construction, the centre of gravity of said two detent latches 86, 88 is above the axis of rotation of said axle body 48, in an off-centre position. As a consequence, under the influence of gravity, both detent latches 86, 88 would therefore rotate about the axis of rotation of said axle body 48 in opposite directions, if such movement were not prevented for the moment by a retaining belt 90. If the rolling shutter door hanging 12 were pushed up, however, the retaining belt 90, which is suspended from the axle body 48 above the axle body 48 bearing the detent latches 86, 88, would become relieved, resulting in said two detent latches 86, 88 rotating until they are stopped by the walls of the guide chamber 78 of the guide rail 26.

FIG. 8*a* shows a variant of an anti-push-up device in which the detent latches 86', 88' are pre-biased by a twisting spring 89.

Figure 9:
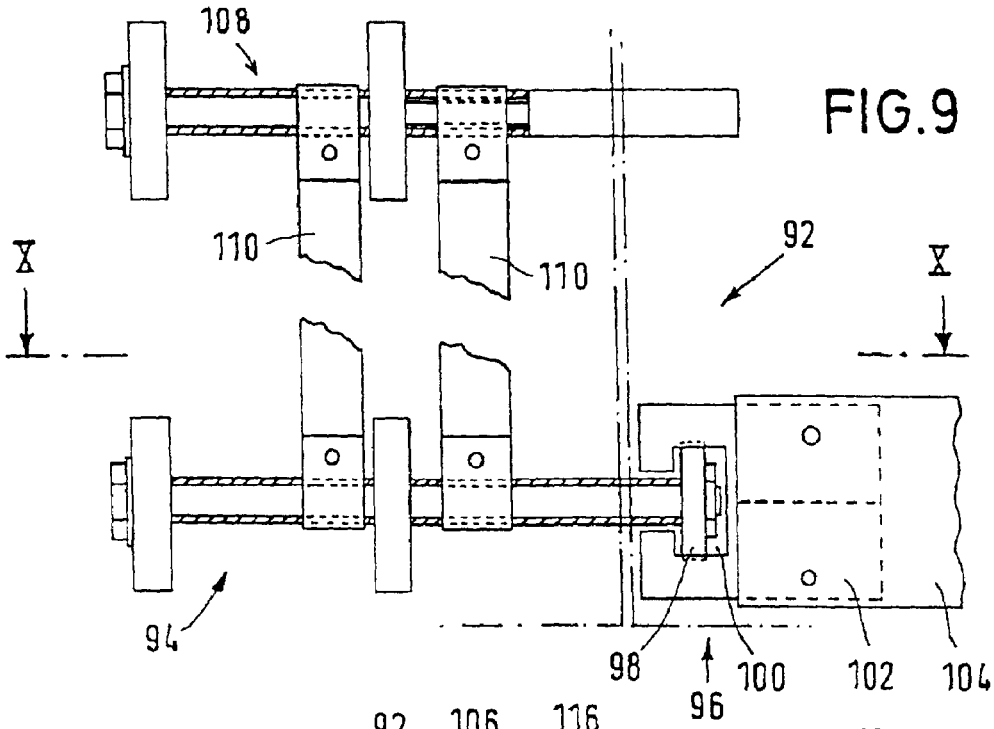
FIG. 9 is one view of a section of a crash protection device according to the invention.
Figure 10:
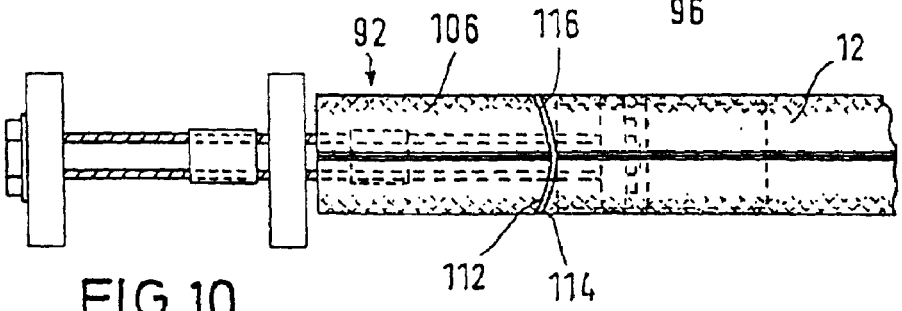
FIG. 10 is a sectional view, taken along lines IX—IX of FIG. 8, of said crash protection device of FIG. 8 with a quick-action rolling shutter door hanging.
Figure 11:
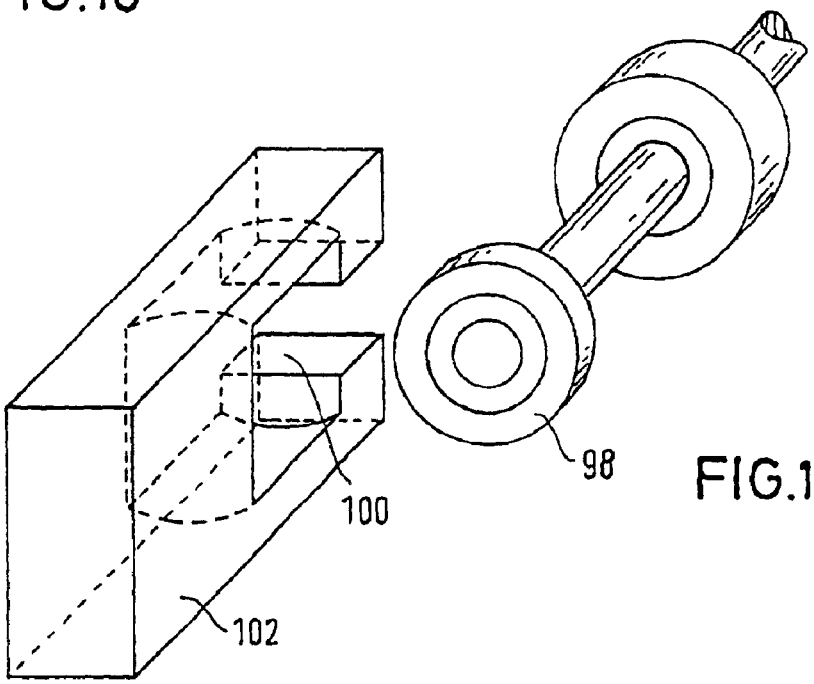
FIG. 11 is a simplified perspective view of a coupling of the crash protection device of FIGS. 8 and 9.

FIGS. 9 to 11 illustrate a crash protection device 92 preventing the destruction of track roller means in the case of a collision of a vehicle with the quick-action rolling shutter door hanging 12. The crash protection device 92, which may be provided as an alternative to the anti-push-up device 84, includes track roller means 94 guiding a coupling 96. Said coupling 96 includes a clamp roller 98 which is accommodated in a support channel 100 of a clamp body 102. Said clamp body 102 is screwed to a floor rail 104 forming the bottom end of the quick-action rolling shutter door hanging 12. In this construction, the support channel 100 of the clamp body 102 is oriented so as to extend transversely to the extension of the quick-action rolling shutter door hanging 102. A minimum holding force between clamp roller 98 and clamp body 102 is obtained in that clamp roller 98 has a rubber-elastic running surface and in that the support channel 100 within said clamp body 102 is concavely shaped both at the top and at the bottom.

So as to enable the clamp roller 98 to become decoupled from the clamp body 102 in the case of a collision, the quick-action rolling shutter door hanging 12, in the region of the crash protection device 92, is cut such that it will not project into the guide rail 26. In order to safeguard a tight closing nonetheless, a cover 106 is provided where the crash protection device 92 is, which cover 106 is of a design corresponding to the laminated construction of the quick-action rolling shutter door hanging 12 and connects the bottom-most track roller device 94 with the track roller device 108 above it. Besides this cover 106, coupling belts 110 are provided which keep track roller device 94 and track roller device 108 at a fixed distance from each other.

In order to accomplish a good sealing between said cover 106 and said quick-action rolling shutter door hanging 12, the opposing edges 112 and 114 of said cover and said quick-action rolling shutter door hanging 12, respectively, are curved complementary towards each other, leaving merely a small sealing gap 116 between them. Since both the quick-action rolling shutter door hanging 12 and the cover 106 are made of an elastic material, the quick-action rolling shutter door hanging 12 and the cover 106 will overlap. During decoupling of the crash protection device 92, some material of the quick-action rolling shutter door hanging 12 and of the cover 106 will be compressed, leaving the lower portion of the quick-action rolling shutter door hanging 12 free.

Figure 11A:
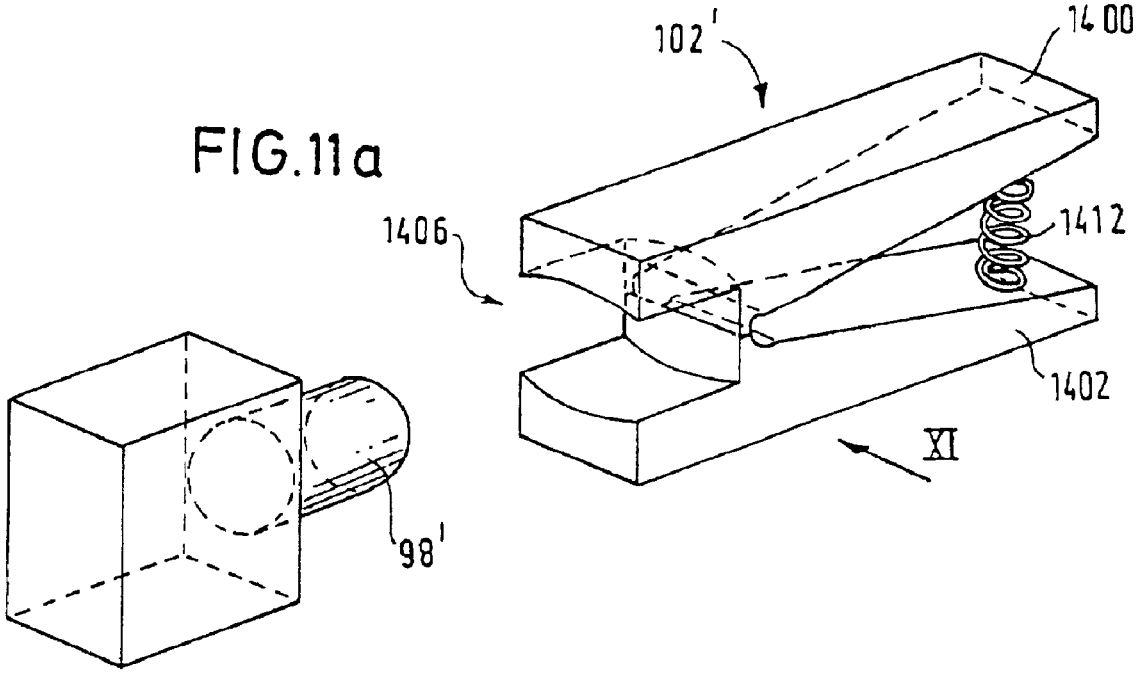
FIG. 11*a* is a simplified view of another embodiment of a coupling for a crash protection device of FIGS. 8 and 9.
Figure 11B:
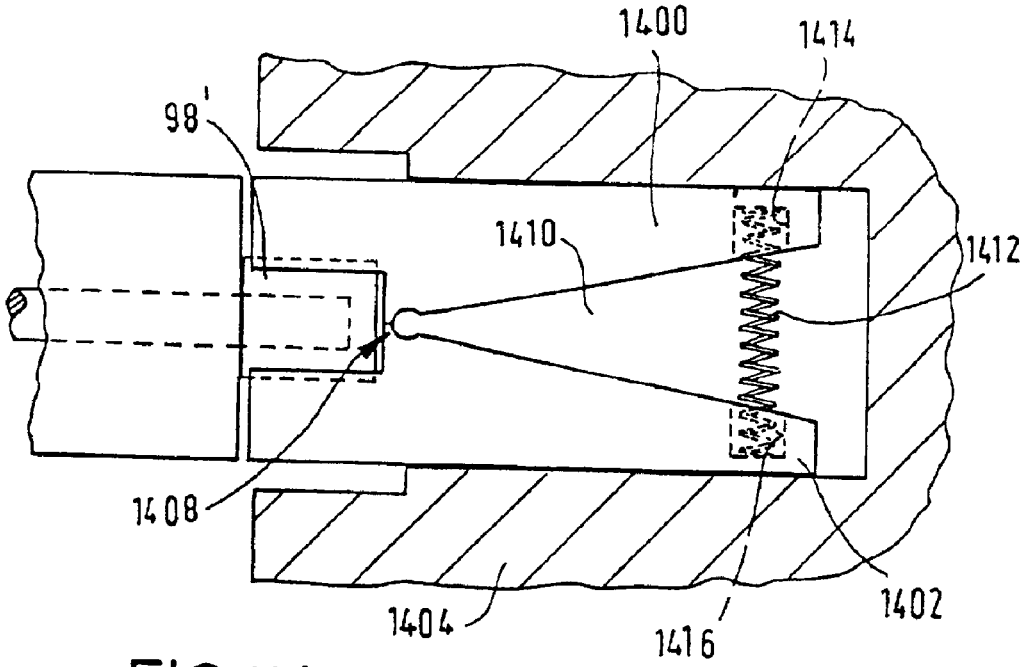
FIG. 11*b* is a view of the coupling of FIG. 11*a* as indicated by arrow XI therein, in the coupled state.

FIGS. 11*a* and 11*b* illustrate a clamp body 102' for a second embodiment of a coupling for a crash protection device. Said clamp body 102' is in two parts, i.e. it comprises upper and lower clamp body halves 1400, 1402 which are both inserted in a recession of a profile 1404 extending transversely to the direction of travel of the door. The (common) end 1406 of said upper and lower clamp body halves 1400, 1402 which faces a clamp roller 98' is shaped like the clamp body 102 of FIGS. 9 to 11, with the only exception that no wheel-like projection is being encompassed here.

The upper and lower clamp body halves 1400, 1402 support each other at a contact surface 1408 and each have bevel or chamfered portions on the side opposing the clamp roller so as to leave a free portion 1410 between them, allowing a pincer-like movement of the two clamp body halves 1400, 1402 towards each other, either to release or to reaccommodate the clamp roller 98'. For pre-biasing the two clamp body halves 1400, 1402 in their holding position, a helical spring 1412 is provided at the end of the clamp body opposing the clamp roller 98', with a pressure load acting on said spring 1412 along its longitudinal axis, said spring 1412 being guided in chambers 1414, 1416 of the upper or lower clamp body halves 1400, 1402, respectively.

The quick-action rolling shutter door 10 shown in FIGS. 1 to 6 can be readily assembled within a very short time according to a scheme known from the furniture industry including assembly instructions in the form of illustrations (FIG. 2). The guide rails 26, 28 and the top 24, which are manufactured according to specifications of the clear dimensions, are prefabricated in production in such a way that the user will not have to perform major measurements owing to the specified screwed connections and mountings, and that these parts allow easy assembly according to the unitized construction principle. First of all, the guide rails 26, 28 are laid out on the floor, screwed to transverse girders and mounted in the wall opening. The screwed connections of the roller support means to the shaft, hanging, motor and the transverse girders were already provided by the manufacturer. Using a forklift truck, the user will lift the prefabricated roller support means and insert it in the mountings intended for this purpose. Subsequently, the top part is secured (in position) by means of screws.

It should further be noted that, in view of the bending behaviour of the foamed material and the steel fabric contained therein, the shaft diameter should be 200 mm at least.

Figure 12:
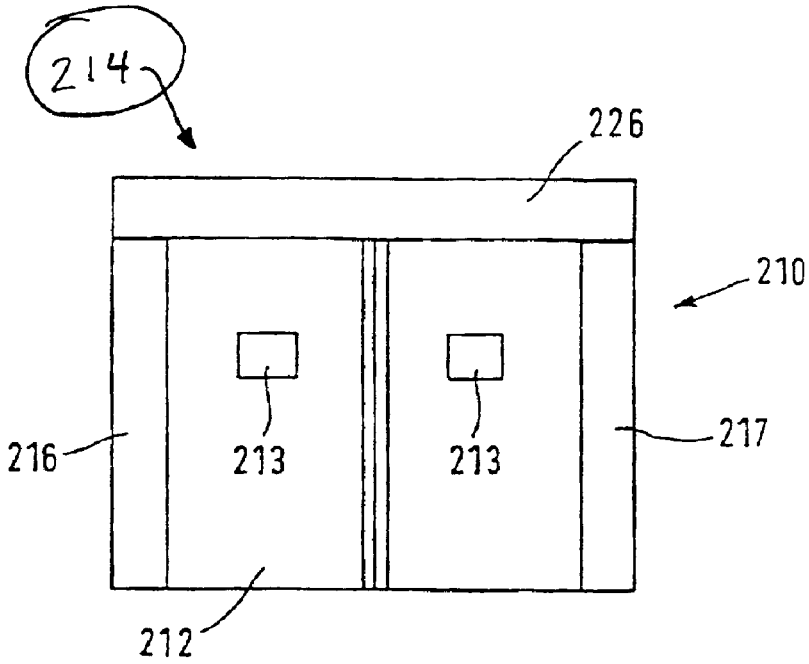
FIG. 12 is a simplified view of a second embodiment of the quick-action rolling shutter door of the invention.

A second embodiment of a quick-action rolling shutter door 210 according to the invention is illustrated in FIG. 12. This quick-action rolling shutter door 210 has a quick-action rolling shutter door hanging 212 which is vertically divided at the centre. The upper end of said hanging 212 extends in a guide rail 226 of a guiding device 214, and said hanging 212 may be laterally wound up onto a first roller 216 and a second roller 217. The quick-action rolling shutter door hanging 212 has two mutually complementary magnet rails at its centre which keep the quick-action rolling shutter door hanging 212 together at its centre in its closed state. For increasing safety around the quick-action rolling shutter door 210, two windows 213 are provided in said quick-action rolling shutter door hanging 212, which windows 213 are of a transparent plastic material and are welded onto the material of the quick-action rolling shutter door hanging 212. A quick-action rolling shutter door hanging of this design is also advantageous in a quick-action rolling shutter door of the first embodiment. The quick-action rolling shutter door hanging 212 which is identical in construction to the hanging 12 of the quick-action rolling shutter door 10 of the first embodiment, may readily be provided with windows 213 since its closed-pore insulating layers do not require any sealing or bordering.

What is claimed is:

1. A quick-action rolling shutter door hanging which can be wound into a generally circular spiral configuration, the hanging comprising:

a first separately formable, thick-walled insulating layer of foamed plastic material; and a second separately formable, thick-walled insulating layer coupled to the first insulating layer alone spaced apart lines extending transversely to a direction of travel of the door hanging, wherein the first and second insulating layers are at least partially uncoupled between the spaced apart lines, and wherein the first and second insulating layers are adapted to assume a curved shape as the first and second insulating layers are wound into the spiral configuration.

2. The quick-action rolling shutter door hanging of claim 1, further comprising a reinforcement onto which the thick-walled insulating layers are coupled.

3. The quick-action rolling shutter door hanging of claim 2, wherein the reinforcement comprises a web of steel wire.

4. The quick-action rolling shutter door hanging of claim 2, wherein the reinforcement comprises a plastic web.

5. The quick-action rolling shutter door hanging of claim 4, wherein the reinforcing plastic web comprises carbon fibers.

6. The quick-action rolling shutter door hanging of claim 2, wherein the reinforcement comprises a cotton web.

7. The quick-action rolling shutter door hanging of claim 2, wherein the reinforcement comprises transverse girder profiles as well as longitudinal strips which extend perpendicularly relative to the girder profiles, the longitudinal strips interconnecting the girder profiles and extending parallel to the direction of travel of the door hanging.

8. The quick-action rolling shutter door hanging of claim 7, wherein the transverse girder profiles comprise at least two parts arranged so as to allow the quick-action rolling shutter door hanging to be sectioned transversely to its direction of travel.

9. The quick-action rolling shutter door hanging of claim 1, wherein the first and the second insulating layer are of a density of between 30 and 250 kg/m3.

10. The quick-action rolling shutter door hanging of claim 1, wherein at least one of said first or said second insulating layers is of a thickness of 10 mm to 50 mm.

11. The quick-action rolling shutter door hanging of claim 1, wherein the first insulating layer has a first surface and second surface substantially parallel thereto, wherein the first surface and the second surface extend transversely relative to the direction of travel of the door hanging;

the second insulating layer has a third surface and fourth surface substantially parallel thereto, wherein the third surface and the fourth surface extend transversely relative to the direction of travel of the door hanging.

12. The quick-action rolling shutter door hanging of claim 1, wherein the second thick-walled insulating layer comprises foamed plastic.

13. A quick-action rolling shutter door hanging which can be wound into a generally circular spiral configuration, the hanging comprising:

a first thick-walled insulating layer of foamed plastic material; and a second thick-walled insulating layer counled to the first thick-walled insulating layer along lines extending transversely to the direction of travel of the door hanging, wherein the first and second insulating layers are adapted to assume a curved shape as they are wound into the spiral configuration, and wherein at least one of said first or second insulating layers has expansion slots extending transversely to a direction of travel of the door hanging, on an external side thereof.

14. A quick-action rolling shutter door of claim 13, further comprising a reinforcement onto which the thick-walled insulating layers are coupled.

15. Use of a flexible plastic sheet of a foamed polyolefin which is cold-resistant up to at least −35° C., has a K-value <2.5, for producing a quick-action rolling shutter door hanging, wherein said flexible plastic sheet is movable between a flat configuration and a spiral configuration.

16. A quick-action rolling shutter door hanging comprising:

a first thick-walled insulating layer of foamed plastic material and having a first surface that extends transversely relative to a direction of travel of the door hanging;

a second thick-walled insulating layer having a second surface that extends transversely relative to the direction of travel of the door hanging;

the first and second layers coupled together at said first and second surfaces along a plurality of spaced apart lines extending transversely relative to the direction of travel of the door hanging; and the first and second layers adapted to deform to a curved shape in response to winding the door hanging into a generally spiral configuration.

17. The door hanging of claim 16, including a wire reinforcing grid disposed between the first and second layers.

18. The door hanging of claim 17, wherein the wire reinforcing grid is formed of steel wire.

19. The quick-action rolling shutter door hanging of claim 16, wherein the second thick-walled insulating layer comprises foamed plastic.

20. A method for forming a rolling shutter door hanging which can be wound into a generally circular spiral configuration, the method comprising:

forming a first insulating layer of a foamed material, the first insulating layer having a first surface that extends transversely along a direction of travel of the door hanging;

forming a second insulating layer having a second surface that extends transversely along the direction of travel of the door hanging; and coupling the first and second surfaces together at a plurality of spaced apart lines to couple the first insulating layer to the second insulating layer, wherein the coupled first and second insulating layers assume a curved shape in response to winding the door banging into the generally circular spiral configuration.

21. The method of claim 20, further comprising:

disposing a wire reinforcing grid between the first insulating layer and the second insulating layer.

22. The method of claim 21, wherein the wire reinforcing grid comprises a web of steel wire.

23. The method of claim 21, wherein the wire reinforcing grid comprises a plastic web.

24. The method of claim 21, wherein the wire reinforcing grid comprises carbon fibers.

25. The method of claim 21, wherein the wire reinforcing grid comprises a cotton web.

26. The method of claim 20, further comprising:

forming expansion slots on at least one of the first and the second insulating layers, the expansion slots extending transversely to the direction of travel of said door hanging.

27. The method of claim 20, wherein forming the first insulating layer comprises forming the first insulating layer with a thickness of 10 mm to 50 mm, and wherein forming the second insulating layer further comprises forming the second insulating layer with a thickness of 10 mm to 50 mm.

28. The method of claim 20, wherein the second insulating layer comprises foamed plastic.

29. A quick-action rolling shutter door hanging which can be wound into a generally circular spiral configuration, the hanging comprising:

a first thick-walled insulating layer of foamed plastic material; and a second thick-walled insulating layer coupled to the first thick-walled insulating layer, wherein the first and second insulating layers are adapted to assume a curved shape as they are wound into the spiral configuration and wherein at least one of the first or second insulating layers has expansion slots extending transversely to a direction of travel of the door hanging, on an external side thereof.

* * * * *

UNITED STATES PATENT AND TRADEMARK OFFICE

CERTIFICATE OF CORRECTION

PATENT NO. : 7,111,661 B2
APPLICATION NO. : 10/107651
DATED : September 26, 2006
INVENTOR(S) : Guido Laugenbach It is certified that error appears in the above-identified patent and that said Letters Patent is hereby corrected as shown below:

Col. 11, line 51 After “insulating layer” delete “alone” and insert -- along --.

Col. 12, line 38 After “insulating layer” delete “counled” and insert -- coupled --.

Col. 12, line 51 After “at least -35°” delete “C.,” and insert -- C, --.

Col. 13, line 26 After “winding the door” delete “banging” and insert -- hanging --.

Col. 14, line 27 After “into the spiral” delete “configuration” and insert -- configuration, --.

Signed and Sealed this

Nineteenth Day of December, 2006

JON W. DUDAS
*Director of the United States Patent and Trademark Office*